United States Patent [19]

Peterson et al.

[11] Patent Number: 4,473,185

[45] Date of Patent: Sep. 25, 1984

[54] METHOD AND DEVICE FOR PRODUCING MICRODROPLETS OF FLUID

[76] Inventors: Folke K. Peterson, Norrtäljevägen 29, S-18245 Enebyberg; Kurt L. Skoog, Borensvägen 1, Johanneshov, both of Sweden

[21] Appl. No.: 276,333

[22] PCT Filed: Oct. 24, 1980

[86] PCT No.: PCT/EP80/00118

§ 371 Date: Jun. 22, 1981

§ 102(e) Date: Jun. 22, 1981

[87] PCT Pub. No.: WO81/01186

PCT Pub. Date: Apr. 30, 1981

[30] Foreign Application Priority Data

Oct. 25, 1979 [SE] Sweden ..... 7908864
Oct. 25, 1979 [SE] Sweden ..... 7908863
Oct. 25, 1979 [SE] Sweden ..... 7908865

[51] Int. Cl.[3] ..... B05B 1/34

[52] U.S. Cl. ..... 239/8; 239/405; 431/9

[58] Field of Search ..... 239/1, 8, 11, 400, 403–406, 239/432; 431/347, 173, 9

[56] References Cited

U.S. PATENT DOCUMENTS

| | | | |
|---|---|---|---|
| 2,047,570 | 7/1936 | Wiltshire | 239/405 |
| 2,254,123 | 8/1941 | Soaper | 239/405 |
| 3,330,267 | 7/1967 | Bauer | 431/347 X |
| 3,734,677 | 5/1973 | Murase et al. | 431/347 X |
| 3,758,258 | 9/1973 | Kölhi | 431/9 |
| 3,758,259 | 9/1973 | Voorheis | 239/404 X |
| 4,105,163 | 8/1978 | Davis, Jr. et al. | 239/406 |
| 4,120,640 | 10/1978 | Martin | 431/173 X |

FOREIGN PATENT DOCUMENTS

| | | | |
|---|---|---|---|
| 1551728 | 4/1970 | Fed. Rep. of Germany | 239/432 |
| 570066 | 6/1945 | United Kingdom | 239/406 |
| 1497832 | 1/1978 | United Kingdom | 239/405 |
| 525837 | 10/1976 | U.S.S.R. | 239/404 |

*Primary Examiner*—Andres Kashnikow
*Attorney, Agent, or Firm*—Andrus, Sceales, Starke & Sawall

[57] ABSTRACT

To produce microdroplets of fluid a liquid jet is injected centrally into an atomizer chamber with the formation of a spray cone and there it is acted upon by an outer spiral-shaped gas flow. To further reduce the size of the droplets, same are introduced into a transport or reaction chamber of short structural length and carried through same by a further spiral-shaped gas flow. Preferably, the transport or reaction chamber is lined by a pot-shaped container, the fluid droplets entering the transport or reaction chamber at the front side opposite an open end thereof. The method or the arrangement for applying the method is particularly suitable for a practically soot free combustion of combustible fluids, particularly oil.

9 Claims, 15 Drawing Figures

FIG. 5A
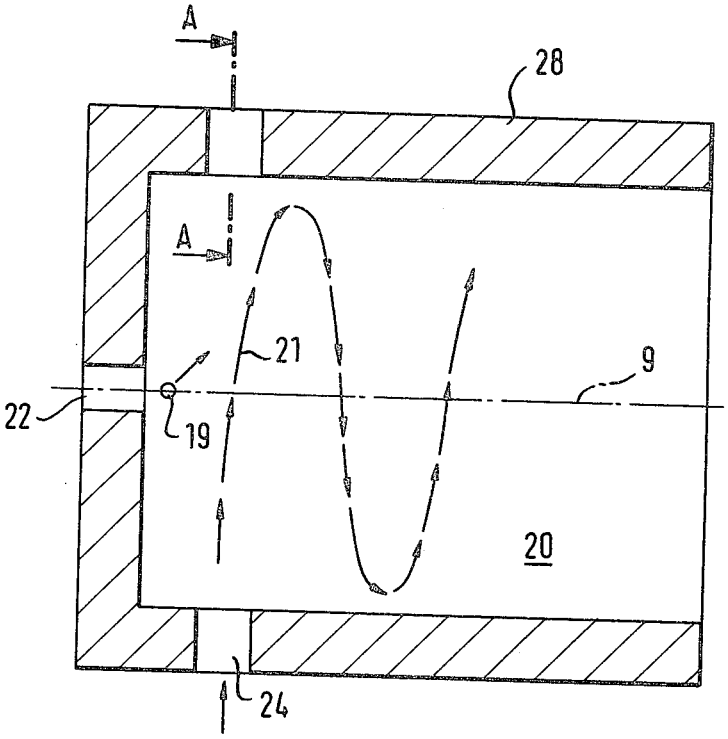
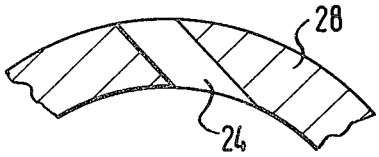
FIG. 5B

FIG. 6A
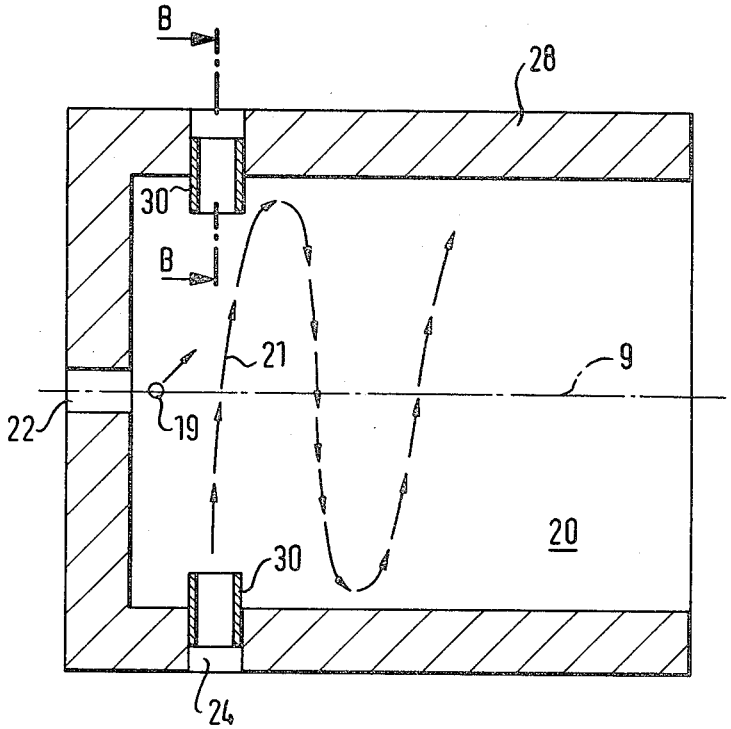
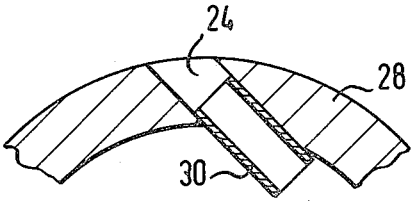
FIG. 6B

METHOD AND DEVICE FOR PRODUCING MICRODROPLETS OF FLUID

BACKGROUND OF THE INVENTION

The invention concerns a method and a device for producing microdroplets of fluid.

In a great number of chemical or physical processes, particularly in drying and combustion processes, it is of great importance to obtain reactive microdroplets of fluid. Ordinarily, a fluid is pressed to this end through a specially designed atomizer nozzle, which effects a spraying apart or an atomizing of the fluid. The atomizing can also be effected with the aid of steam or compressed air, whereas these methods are not used with small amounts of fluid.

It is also generally known how to improve or accelerate the exit of a fluid jet from a nozzle through a gas flow surrounding the emerging jet in concentrical manner. However, the gas flow is not intended to effect an atomization of the fluid emerging from the nozzle but rather, on the contrary, to hold together the jet of the fluid. Finally, it is also known how to convey a rotary movement to the thin gas mantle holding together the fluid jet or also a droplet sponge, in order thereby to obtain a rotation of the fluid jet proper (DE-OS No. 1 475 162). However, also with this known solution the intention is to avoid an atomization of the fluid or further fine atomization.

The present invention is now based on the problem of creating a method and a device for producing microdroplets of fluid, which method or which device permits an extremely fine atomization also at a very low fluid pressure.

This problem is solved with regard to the method of the invention in that a fluid is injected from an opening into an atomizer chamber in such a manner that a substantially hollow spray cone is formed and that this spray cone is acted upon by an external gas flow, the flow path of which is approximately concentric and spiral-shaped in relation to the theoretical axis of the spray cone, so that the spray cone is broken up by the flow of the gas.

In accordance with the invention a violent collision of the fluid and the flow of gas is brought about intentionally and in controlled manner. Thereby it is possible to obtain also a fine atomization at a very low pressure of the fluid emerging from the opening. A maximum fine atomization is obtained with the method of the invention even with very small amounts of flow.

Preferably, the radius of the spiral-shaped path of the flow of the gas in the direction away from the opening, through which the fluid is injected into the atomizer chamber, is reduced to an ever increasing extent at a uniform rate, is possible. Thereby the flow of gas experiences an additional acceleration, with the consequence that the droplets of fluid carried along, are broken up to an increasing extent. Extremely fine droplets of fluid or microdroplets of fluid are obtained in the order of magnitude of about 20 μm. Such a small mean size of droplets cannot be obtained with the known atomizer nozzles or methods. In most instances a reduction of the mean size of the droplets to a level below 50 μm was unsuccessful due to the limited possibilities of manufacturing technology available. There are spray nozzles for such a coarse dispersion with nozzle slots uniformly distributed over the periphery having a width of about 100 μm each. Since manufacturing tolerances between 98 μm and 102 μm cannot be avoided, such spray nozzles result in an uneven distribution of the spray or an uneven distribution of the droplets. In addition, it was shown that spray slots having a width of about 100 μm can be easily and quickly clogged up when fluids are used which contain solid particles (impurities), for example oil, after a short time, when such fluid is used for atomizing. Subsequently, after having been used for a longer period of time the distribution of the droplets is nonumiform. Impurities may lead to wear and tear which, in its turn, results in a nonuniform distribution. To further reduce the size of the droplets it has been shown that it is advantageous to introduce the droplets of the fluid through an opening into a preferably cylindrical transport chamber and to carry them by way of a spiral-shaped flow of gas to the end opposite to the inlet opening, which end is preferably open.

It is known that with the aid of a flow of gas it is possible to carry droplets of fluid from one point to another along a usually rectilinear path, where the section of conveyance is dimensioned in such a way that the droplets react chemically during their movement along this section, or experience a physical transformation, for example evaporation. The solution suggested by the invention now offers the advantage that the mentioned reactions can take place over a relatively short structural length of the transport chamber. Precisely with combustion units it is of special importance to obtain an overall compact installation.

By means of the last mentioned solution an extremely long transport section is obtained for the droplets of the fluid carried along by the flow of the gas, by way of a chamber, the structural design of which is relatively short. This makes it possible, for example, to bring droplets of the fluid in a very small "reaction chamber" or transport chamber to a complete evaporation. The method according to the invention is particularly suitable for drying and burning fluids, because it is generally known that with smaller droplets a drying or combustion process takes place faster and is more complete. The dependence between processing time t (time of drying or combustion) and diameter of the droplets d is as follows:

$$t = c \cdot d^{1.8},$$

where c is a constant. The processing time t is the period of residence required in the transport or reaction chamber, where due to the path of movement of the droplets in the transport chamber as provided by the invention, this time limit can also be met with a very small transport chamber.

In most cases it must be avoided that the droplets of the fluid in the atomizer chamber and/or transport chamber or reaction chamber come into contact with the inner surface of the chamber walls. Corresponding deposits on the inner surface of the chamber walls should be avoided. In order to achieve this, the gas is introduced into the atomizer chamber and/or transport chamber advantageously at a distance from the inner surface of the chamber walls.

In order to obtain a still greater fineness of the droplets of the fluid, the gas can be given a spinning or rotary movement of its own along the path of the flow. Then the flow of the gas is characterized by two superimposed rotary movements.

In accordance with the apparatus aspects of the invention, an apparatus for producing microdroplets of fluid broadly comprises a small tube the outlet opening of which is generally centrally located within an atomizing chamber, and a plurality of gas inlet passages radially spaced from the small tube opening and adapted to impart a spiral-shaped motion onto gas introduced into said atomizing chamber through the gas inlet passages. Preferably the cross-section of the atomizing chamber decreases in the direction of flow towards the outlet of the atomizing chamber, such decrease desirably being uniform.

In accordance with still further apparatus aspects of the invention, the apparatus may further comprise a transport chamber having at one end thereof an inlet opening in flow communication with the outlet of the atomizing chamber, and a plurality of gas entry openings radially spaced from the inlet opening of the transport chamber and adapted to impart a spiral-shaped motion onto gas introduced into the transport chamber through the gas entry openings; the other end of the transport chamber being preferably open. In one form of the apparatus, at least one of the gas entry openings is provided at the one end of the transport chamber, and guide plates are provided for deflecting the gas to impart the spiral motion thereto. In another form of the invention, at least one gas entry opening is formed by a bore extending in an oblique manner to the radial line of the transport chamber in a lateral wall forming a lateral boundary of the transport chamber. Desirably a tube is inserted within the bore so as to project beyond the inner surface of the lateral wall whereby contact of fluid droplets introduced into the transport chamber may be reduced.

Following is a description of the details of the method of the invention on the basis of the preferred embodiments of the device according to the invention presented schematically in the enclosed drawings.

FIGS. 1*a*, 1*b*, 1*c* and 1*d* show various embodiments of fluid atomizing chambers (longitudinal section);

Figure 1A:
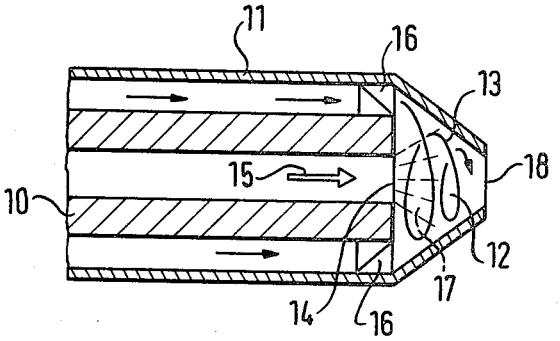
Figure 4:
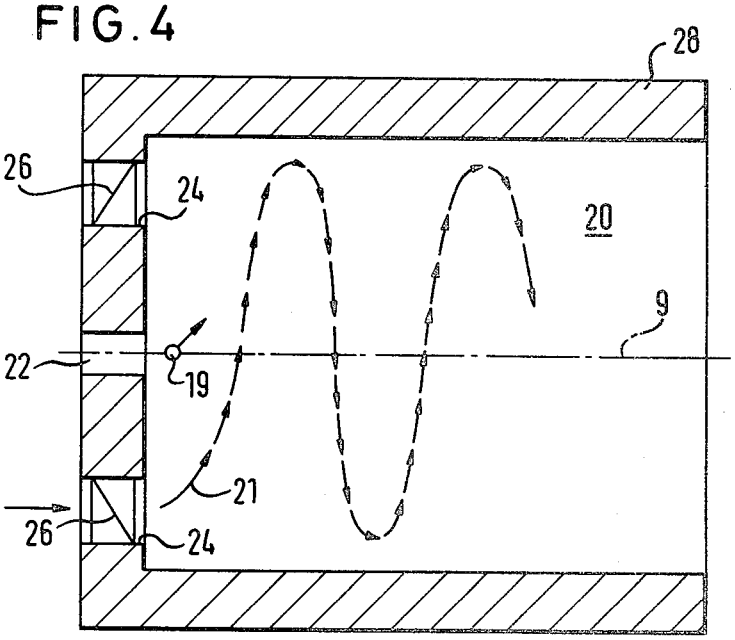
Figure 7:
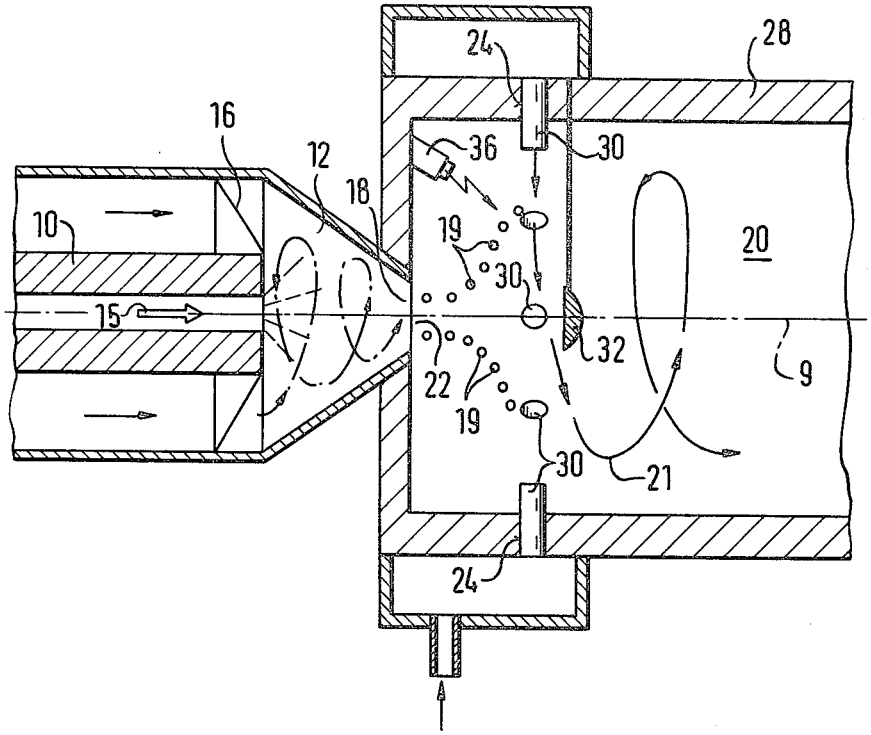
Figure 8:
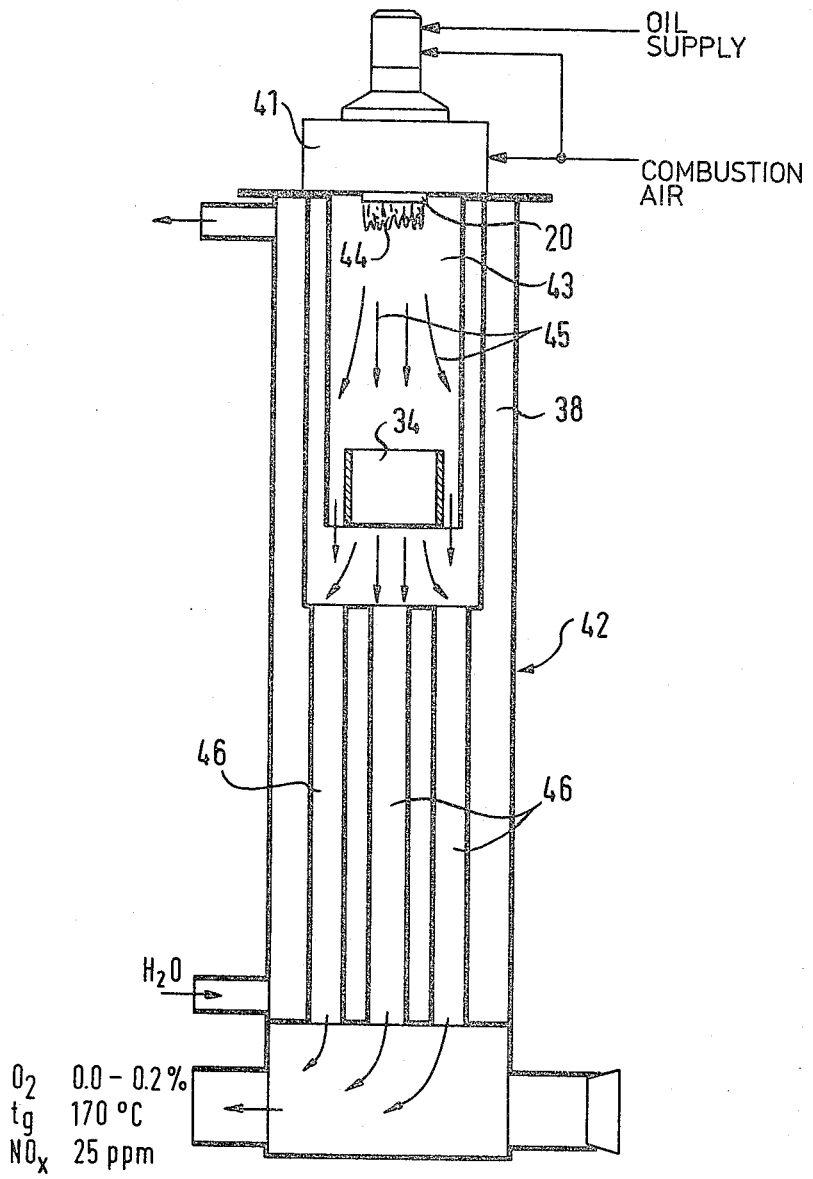
Figure 9:
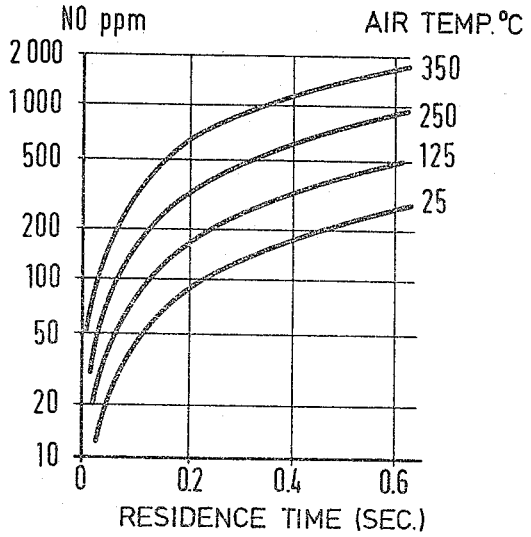
Figure 10:
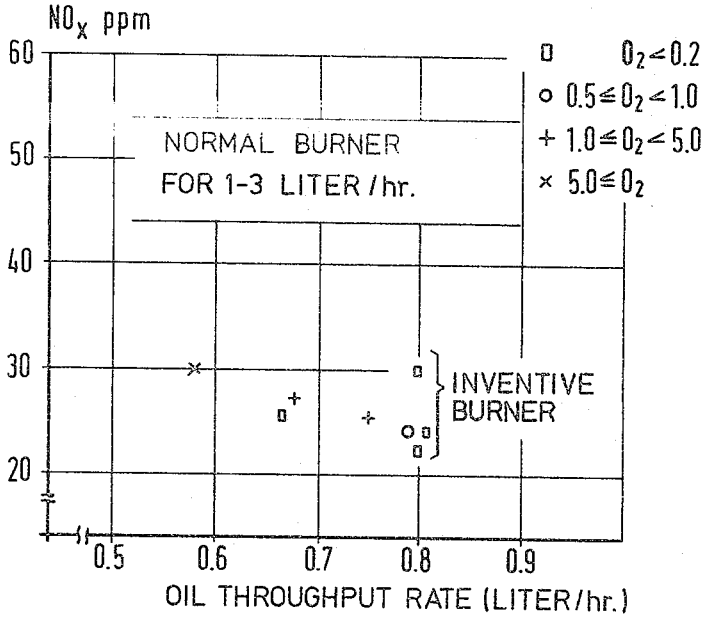

FIGS. 4, 5*a* and 6*a* show three different embodiments of transport or reaction chambers in cross section;

FIGS. 5*b* and 6*b* are views along arrows A—A and B—B of FIGS. 5 and 6 respectively;

FIG. 7 shows a combination of the atomizer unit according to FIG. 1*a* and a reaction unit according to FIG. 6 for the production of finest droplets of fluid;

FIG. 8 shows an arrangement of the unit according to FIG. 7 in a heat exchanger; and FIGS. 9 and 10 show graphic presentations to demonstrate the advantageous effect of the unit according to FIG. 7.

A good atomization of a fluid can be obtained by the atomizing units shown in FIGS. 1*a*, 1*b*, 1*c* and 1*d*, which consist in each case of a centrally located small tube of fluid 10, a cylindrical mantle 11 surrounding it concentrically with a conically tapering atomizer chamber 12 and gas conducting means or gas inlet openings 16 provided in oblique manner relative to the longitudinal axis of the tube at the outer circumference of the small fluid tube 10, which impart a spinning motion 13 on the pressure or atomizing gas flowing around the small fluid tube 10 in longitudinal direction.

The opening of the small tube or the inlet opening for the fluid 14 is designed in such a manner that the jet of the fluid 15 is dispersed in cone-shaped manner when leaving the opening 14 (hollow spray cone 17).

Thereby a violent collision of the fluid with the flow of the gas 13 is achieved, where the gas flow 13 is accelerated in the direction toward the outlet opening of the atomizer chamber 18 due to the continued decrease of the diameter of the spiral-shaped flow of gas. Thus the flow of gas breaks up the spray cone 17 into individual droplets of the fluid.

Figure 1B:
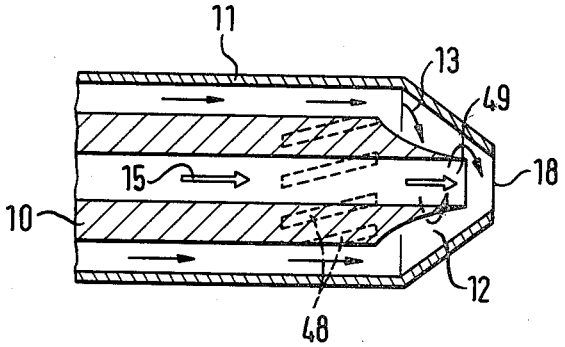
Figure 1C:
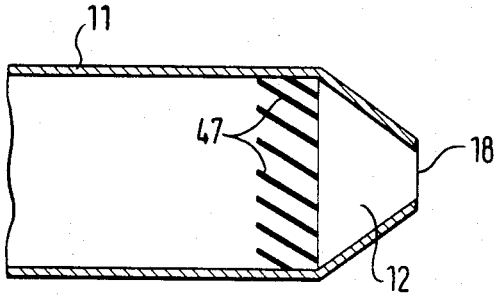

In FIG. 1*c* guide plates 47 are provided in the gas inlet passages for the purpose of deflecting the gas flow.

In FIG. 1*b* spinning slots 48 are provided at the outer circumference of the small fluid tube instead of the guide plates 47 in FIG. 1*c*, which equally convey a spinning motion to the atomizing gas. The end 49 of the small fluid tube 10 protruding into the atomizer chamber 12 extends, in the embodiment of FIG. 1*b*, up to a point close to the outlet opening 18, so that directly in front of this opening an extremely violent collision of dispersion gas and emerging fluid takes place. The fluid is almost "burst" directly prior to its exit from the atomizer chamber 12. Here the outer surface of the part of the small tube 10 which extends into the atomizer chamber 12 in the embodiment of FIG. 1*b*, is designed inconical shape in accordance with the atomizer chamber.

Figure 1D:
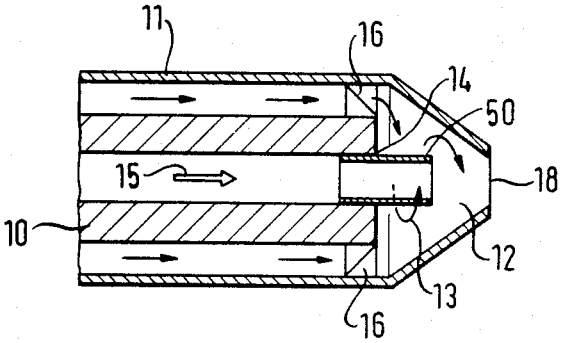

With the embodiment according to FIG. 1*d* the extension of the small fluid tube 10 is achieved with a small tube 50 inserted into the opening 14 of same; preferably tube 50 is longitudinally adjustable within small fluid tube 10.

In the conical mantle part forming the lateral boundary of the atomizer chamber, gas inlet passages may still be provided for the droplets of fluid and the inner surface of the walls of the atomizer chamber and thus safely avoid deposits on same. The secondary gas may equally be pressure gas and is preferably introduced in such a manner that the spinning motion 13 of the atomizing gas is additionally supported.

Figure 2:
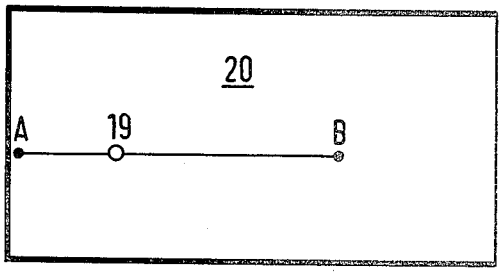
FIG. 2 shows a schematic presentation of a movement of a droplet of the fluid along a rectilinear section within a transport or reaction cylinder.
Figure 3:
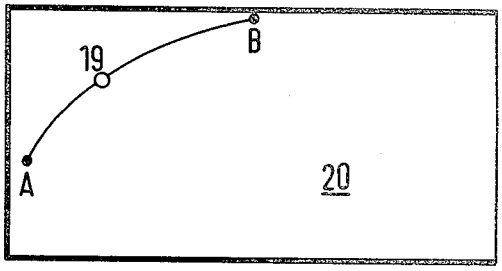
FIG. 3 shows the movement of a droplet of the fluid along a curved line.

In order to encourage chemical or physical reactions with the droplets of the fluid obtained in the atomizer units shown in FIGS. 1*a*–1*d*, for example in the atomizer chamber 12, same are moved through a transport chamber or a reaction chamber along a predetermined path. FIGS. 2 and 3 show therein cylindrical transport chambers 20, which are open at the right end. A droplet 19 is removed from a point A to a point B. The droplet is to evaporate along this section, as an example. FIG. 3 shows that when the droplet is moved along a curved line, the distance between points A and B is smaller than with a movement along a rectilinear path (according to FIG. 2). The actual path of movement is the same, of course. With a movement along a curved line according to FIG. 3, however, the movement is utilized in the second dimension; this results in a shorter distance between the two terminal points of the path of movement.

Following this finding the droplets are led or carried along a three-dimensional path through the transport or reaction chamber 20 according to the solution suggested by the invention.

With the embodiment according to FIG. 4 the droplets 19 enter the transport chamber 20, which is lined by a pot-shaped container with a lateral wall 28, through an inlet opening 22 for droplets, which is located at the centre of the front of the pot-shaped container. There are several openings 24 evenly distributed over the circumference at a radial distance from the opening 22, for the gas entry into the transport chamber 20, while in each case obliquely positioned guide plates or fins 26 are provided in the openings 24, which effect a spiralling flow of gas around the longitudinal axis 13 of the transport or reaction chamber 20.

The embodiment according to FIG. 5 is very similar to the embodiment according to FIG. 4 as to its structure, only with the difference that the gas inlet openings 24 are located in the lateral wall 28 of the pot-shaped container. Here more than one gas inlet opening may be provided. The gas inlet openings 24 are positioned in oblique manner relative to the radius (as clearly shown by cross-section A—A), in order to impart to the flow of gas (see arrows) a predetermined spiral movement through the transport chamber 20. The internal diameter of the pot-shaped casing may be dimensioned in such a manner that the flow of gas has practically no longer any effect on the inner surface of the lateral wall 28. Thus the danger of a deposit of droplets of fluid or of their reaction products on the inner surface of the lateral wall 28 is averted. Such deposits would result with a change of flow conditions and after a certain time of operation make a cleaning of the transport or reaction chamber 20 necessary.

To be completely certain that the droplets do not deposit on the inner surface of the lateral wall 28, it is possible to insert into the openings 24 small tubes 30 projecting beyond the inner surface of the lateral wall 28 (compare FIG. 6 with the corresponding cross-section B—B).

For an adjustment to various sizes of droplets, reaction times of the droplet material etc. it may be advantageous to have the small tubes 30 inserted in the openings 24 in adjustable manner, so that the length of the part which protrudes from the inner surface of the lateral wall 28 is variable. The simplest way to solve this problem is to screw the small tubes 30 into the openings 24.

As was explained in the foregoing, preferably also the direction of the jet of the openings 24 or the small tubes 30 for adjustment to different droplet sizes etc. is variable.

FIG. 7 shows a combination of the atomizer unit schematically presented in FIG. 1 and the transport or reaction unit schematically presented in FIG. 6. The droplets of the fluid produced in the atomizer chamber 12 reach—through the exit openings 18 or inlet openings 22 of the droplets—the transport chamber 20, while they experience an approximately cone-shaped dispersion there, which surprisingly is encouraged by the gas introduced through the small tubes 30. Apparently a reduced pressure arises in the ring space between the closed front side of the transport chamber 20 and the small gas tubes 30, which pulls the droplets of the fluid emerging from the opening 22 toward the outside in radial manner. Thereby the droplets of the fluid 19 reach the area of the gas flow the shortest way, which is indicated by reference number 21 in FIG. 7.

In order to additionally increase the dispersion of the droplets of the fluid introduced into the transport chamber, a distributing unit 32 is provided at a distance before the inlet opening 22 of the droplets of the fluid, the side facing the opening 22 being designed level. Depending upon the outer parameters such as the velocity of gas entry, the size of the droplets etc., the surface of the distributing unit 32 facing the opening 22 may also be designed in convex or cone-shaped manner.

Thus the distributing unit 32 favours a quick mixing of the droplets with the gas flow 21, where the degree of mixture can be adjusted by the shape of the distributing unit 32. Also, the distance of the distributing unit 32 from the opening 22 has an influence on the degree of mixing or spreading of the droplets of the fluid, introduced into the transport chamber. Therefore, to vary the degree of mixture or spreading, the distributing unit 32 is positioned preferably in such a manner that it can be adjusted back and forth in the direction of the longitudinal axis 13 of the transport or reaction chamber 20. Good results can be obtained if the distributing unit 32 lies flush with the inlet opening 22 for the droplets of the fluid and the plane defined by the small gas tubes 30 close to same. The distributing unit 32 contributes in particular to a uniform distribution of the introduced droplets 19 over the cross-section of the transport or reaction chamber 20. Thus the distributing unit 32 prevents local accumulations of droplets whereby a uniform intermixture into the gas flow 21 is obtained. With the embodiment according to FIG. 7 the distributing unit 32 is attached to a rigid wire. But also other possibilities of attachment are conceivable; however, attention must be paid that the attaching means do not have an adverse influence on the flow, particularly the spinning motion of the flow of gas and the droplets in the transport chamber 20.

In the event the transport chamber or the reaction chamber 20 is to serve as a combustion chamber, preferably an ignition device 36 is provided in the area of the inlet opening 22 for the droplets, in order to start the combustion of the droplets of the fluid, for example oil droplets.

In FIG. 8 the unit according to FIG. 7 is used as an oil burner and indicated by reference number 41. The burner 41 is provided at the upper end of an upright heat exchange 42, the transport or reaction chamber 20 slightly protruding into an exhaust gas chamber 43. In the embodiment schematically presented in FIG. 8 the reaction chamber 20 serves as a combustion chamber, where the flame 44 extends somewhat out from the combustion chamber 20. The hot combustion gases are conducted through the exhaust gas chamber 43 as shown by the arrows 45; at the end of the exhaust gas chamber 43 away from the burner, a tube-shaped radiator unit 34 is provided in the interior of the exhaust gas chamber in concentrical manner. The outer diameter of the tube-shaped radiator unit 34 is somewhat smaller than the inner diameter of the exhaust gas chamber 43, which is also designed in tube-shaped manner in the embodiment shown. Both the radiator unit 34 and the wall of the exhaust gas chamber 43 are preferably made of heat-resistant metal (sheet) featuring a dark, preferably black, colouring, so that they serve as ideal radiator units. The additional radiator unit 34 and the exhaust gas pipe limiting the exhaust gas chamber 43 assist the heat exchange between the hot combustion gases and the surroundings; which, in the case before us, is a heat exchanger medium 38 conducted at a distance past the exhaust gas tube.

A heat exchange takes place by way of convection between the hot combustion gases and the exhaust gas pipe and in particular the black radiator unit 34. The heat taken up by the exhaust gas pipe and/or radiator unit 34 is returned to the surroundings or the heat exchanger medium 38 by way of radiation, and carried to another place by same.

In addition to the tube-shaped radiator unit 34 or in its place black radiator units can be provided also behind the exit of the exhaust gas tube or in the gas conduction canals 46 extending through the heat exchanger 42, the hot combustion gases "flowing around". The shape of the radiator units may, for example, be that of an egg. However, also tube-shaped radiator units may be used. Naturally, attention must be paid that no too large a drop in pressure is caused by the arrangement of the radiator units in the gas conduction canals.

The black radiator units consist of metal, preferably of heat-resistant, stainless steel. But they may just as well consist of ceramic material or stone. The material depends upon the gas flowing around the radiators or upon the chemical and/or physical reactions taking place in the reaction chamber 20.

With a location of the radiator units at a relatively great distance from the combustion flame the flame temperature and thus the combustion will not be influenced by the radiator units.

With a location of the radiator units in the immediate vicinity of the flame or the reaction place a cooling effect is achieved by the radiator units which, after all, deliver heat to the outside, that is to the surroundings; this cooling effect may result, for example, in a reduction of the reaction velocity or a situation without any reaction at all (e.g. cracking processes).

With some chemical or physical processes it may also be necessary to supply heat from outside for the development of the reaction. As a rule, this was so far accomplished by heating the reaction chamber with a heating system or the like. It has now been shown that by using the radiator units described in the foregoing in the reaction chamber, the heat transfer from outside into the reaction chamber can be intensified considerably. The radiator units provided in the reaction chamber make it possible to obtain an additional heat supply by means of heat radiation.

The radiator units are also particularly suitable for a subsequent controlled combustion of exhaust gases in an exhaust gas canal. To this end the radiator units are provided in the exhaust gas canal at a suitable distance from the combustion flame and heated from outside. The heat then delivered by the radiator unit by way of convection to the exhaust gases causes a subsequent ignition of the exhaust gases so that a complete combustion is obtained prior to the exit of the exhaust gases into the open air.

As the foregoing explanations clearly show, the described invention is particularly suitable for an oil burner. Therefore, in the following the analysis will in detail go into the conditions prevailing in an oil burner and into the advantages which are obtained through the solution suggested by the invention.

There are numerous methods of reducing the formation of soot with an oil burner. Some of these methods are described in detail, for example in a publication by Peterson and Skoog entitled "Stoftbildning vid oljeeldning" (Dust Formation With Oil Heating), Stockholm, 1972. The known methods refer mainly to the utilization of heavy oils. Among these methods the use of an emulsion of oil and water proved the most suitable one. But with this method the formation of small soot particles which lead to aggressive $SO_3$ concentrations, cannot be avoided, if light oils are used as fuel. The formation of the small soot particles harmful to the human lung, can be reduced by improving the combustion. The combustion intensity or flow rate of mass, which is burned per unit of oil mass, can be defined as follows:

$$\dot{m} = \frac{3}{2d}(c_y - c_f) \cdot \rho\beta, \qquad (1)$$

where $\dot{m}$ = the flow rate of the mass per unit of mass of one droplet;

d = the diameter of the droplet;

$c_y$ = the concentration of the "oil vapour" on the surface of the droplet;

$c_f$ = the vapour concentration in the flame;

$\rho$ = the density of the oil at drop temperature; and $\beta$ = the transfer coefficient for the vapour.

From the above equation (1) it can be seen that the combustion intensity is increased with a. a reduction of the diameter of the droplet;

b. an increase in the value of $c_y$ which can be increased by higher oil temperature, for example by preheating; and c. an increase in the magnitude of $\beta$, which is determined by the following equation:

$$\beta = \frac{D}{d} \cdot p_f/p_{tot}, \qquad (2)$$

where

D = the diffusion coefficient;

$P_f$ = the partial pressure corresponding to the magnitude of $c_y$; and $P_{tot}$ = the overall pressure in the burning zone.

The application of the equation (2) is confined to the case where there is no influence of a relative movement between the droplets and the surrounding medium.

As can be seen from the equation (2), the magnitude D—and consequently the magnitude $\dot{m}$—can be increased by a higher temperature of the ambient medium of the oil droplet, as a rule of the ambient air, because the magnitude of D is contingent upon the temperature and $dD/dT > 0$. Thus the size of the droplets is of great importance because smaller droplets result in a greater magnitude of $\beta$.

Summarizing it is thus found that the combustion can be improved by small oil droplets;

higher temperatures of the medium surrounding the droplets, mostly air; and higher temperatures of the oil to be burned.

The first requirement is met in an optium manner by a nozzle according to FIGS. 1*a*–1*d*. The second requirement can be met very easily by introducing preheated air in each case into the atomizer chamber 12 and if applicable into reaction chamber 20.

The third requirement can be met equally in very simple manner by preheating the oil to be burned.

As was explained in detailed manner already in the foregoing in connection with the reaction chamber 20, a period of residence of the droplets in the reaction chamber 20 is achieved which is sufficient for a complete combustion, by the movement of the droplets of the fluid in spiral fashion according to the invention, although the reaction chamber 20 is designed as a very short structure. The short structure of the reaction chamber 20 moreover offers the advantage that losses in heat radiation within the area of the reaction chamber are correspondingly small.

Despite the short structure of the reaction chamber 20 a complete combustion is ensured in this chamber under the solution suggested by the invention.

Experiments have shown that the soot formation during the application of the method in accordance with the invention or the utilization of the device according to the invention as per FIG. 7 is almost zero. Here it has proven advantageous to introduce about 15% of the pressure gas available into the atomizer chamber and 85% into the transport chamber, if the atomizer chamber and the transport or reaction chamber are provided one behind the other. The velocity of the pressure gas introduced into the transport chamber, for example air, preferably amounts to about 50 to about 150 m/second. These values have proven especially advantageous; in particular, excess air which results in undesirable $SO_3$ formations, is avoided. The formation of a small amount of $SO_3$ also results in a decreasing soot formation, as was proven already by Gaydon et al. in the publication called "Proceedings of Royal Society", London, 1947.

A few words will be said in the following about the formation of nitrous oxides. Nitrous oxides ($NO_x$) are very harmful, particularly for animals and humans. For this reason, the laws of numerous countries require that the nitrous oxide concentration in exhaust gases may not exceed a specific level. In Germany the nitrous oxide concentration in oil burners (operated on heavy oil) may not exceed 500 ppm in the exhaust gas.

The formation of nitrous oxides is a consequence of the proportion of nitrogen atoms in the oil forming substances. About 50% of the nitrous oxides which are formed during the combustion, come directly from the oil forming components;

the formation of nitrous oxides during the combustion.

In the latter case NO and $NO_2$ are formed. The formation of NO was intensively examined. The following results were obtained:

an increased flame temperature reduces the formation of NO;

a small excess of air contributes to the formation of NO;

the formation of NO is greatly dependent upon the time available for this process. In this connection reference is made to FIG. 9 in which the formation of NO is shown in graphical manner as a function of the time of residence of the combustion gases in the combustion chamber. From FIG. 9 it can also be seen that the formation of NO is dependent upon the temperature of the air used for the combustion.

When the unit according to FIG. 7 is used as an oil burner, a correspondingly short period of residence of the combustion gases is obtained due to the small structure (extremely short reaction chamber 20). In addition, the burning time proper is reduced to a minimum due to the extremely small droplets of the fluid or oil. The period of residence of the droplets and exhaust gases in the unit according to FIG. 7 is about 0.07 sec. According to FIG. 9 about 20 ppm NO are formed when the unit is used according to FIG. 7 as an oil burner. With this short period of residence it makes hardly any difference if the combustion air is preheated. As described in the foregoing, the combustion proper or the combustion intensity is improved by preheating the combustion air.

FIG. 10 shows the $NO_x$ values of an oil burner designed in accordance with the invention compared with conventional oil burners, again in a schematical manner, that is as a function of the oil throughput rate (1/h) and the proportion of oxygen during the combustion.

Thus the utilization of the device according to FIG. 7 with the atomizer unit and reaction unit as an oil burner leads to an optimum of sootfree combustion with an extremely small amount of excess air at a degree of efficiency of at least 92%.

The preceding description of the preferred embodiments is illustrative of the broad aspects of the invention earlier described and further aspects within the scope thereof. It is not to be taken as limiting the invention, the scope thereof being in accordance with the spirit of the claims appended hereto.

The embodiments of the invention in which an exclusive property or privilege is claimed are defined as follows:

1. A method for producing microdroplets of fluid, comprising:

injecting a fluid through an opening into an atomizer chamber in a flow pattern including a substantially hollow spray cone, directing said fluid spray cone into a confining transfer chamber, introducing an external gas flow onto said spray cone in a flow path approximately in a concentric and spiral-shaped configuration in relation to the theoretical axis of the spray cone and downstream from the entry opening of the confining transfer chamber and thereby creating a reduced pressure about the spray cone, said gas flow impinging on and breaking up said spray cone for producing microdroplets of said fluid.

2. A device for producing microdroplets of fluid including:

an atomizing chamber, a small fluid tube (10) terminating in said atomizer chamber (12), at least one gas inlet passage (16) provided at a radial distance from the small tube opening (14) to establish a gas flow into said atomizing chamber and constructed and arranged to engage and impart a spiral-shaped motion to the gas introduced into the atomizer chamber and to create a spray cone into an outlet opening, a generally tubular transport chamber (20) having an inlet opening connected to said outlet opening of said atomizer chamber for receiving said spray cone from said atomizer chamber, said transport chamber including a plurality of gas entry openings (24) located downstream from said inlet opening and provided at a radial distance from the inlet opening of the transport chamber for said spray cone said opening being constructed and arranged with an oblique angle to the radial line of said spray cone and imparting on the gas of said spray cone introduced into the transport chamber (20) a concentric and spiral-shaped motion in relation to the inlet opening.

3. The device of claim 2 wherein said transport chamber includes an outer wall (28) having an outer opening (24), a tube (30) inserted into said outer opening (24), said tube projecting inwardly of the outer wall (28) such that the spray cone carried through the transport chamber by the spiral-shaped gas flow is spaced from the inner surface of said lateral wall.

4. The device of claim 3 wherein said tube (30) is adjustably mounted for controlling the projection into the transport chamber (20).

5. The device of claim 2 wherein said opening (24) is angularly oriented in the direction of the flow.

6. The device of claim 2 having a distributing unit (32) mounted in the transport chamber (20) in spaced relation to the inlet opening (22) for establishing a radial dispersion and substantially equal distribution of the droplets introduced into the transport chamber over the cross-sectional flow path within the chamber.

7. The device of claim 6 wherein said distribution unit (32) is a plate having a convex surface.

8. The device of claim 2 including dark, heat absorbing radiator units (34) located behind the transport chamber (20) and radiating heat absorbed by the mixture of droplets and gas.

9. The device according to claim 8 wherein a first tube member is mounted to the transport chamber and extends therefrom to an outer end, and said radiator unit is a tube section located concentrically within said first tube member (42) and located adjacent the outer end of said first tube member.

* * * * *

UNITED STATES PATENT AND TRADEMARK OFFICE

CERTIFICATE OF CORRECTION

PATENT NO. : 4,473,185

DATED : September 25, 1984

INVENTOR(S) : FOLKE KARL PETERSON ET AL

It is certified that error appears in the above-identified patent and that said Letters Patent are hereby corrected as shown below:

Col. 6, Line 51, after "metal" delete "sheet" and substitute therefore ---steel---; Col. 8, Line 24, the equation should read ---$B = \frac{D}{d} \cdot p_f/p_{tot}$---; Col. 8, Line 28, "$P_f$" should read ---$p_f$--- (small p)

Signed and Sealed this

Sixteenth Day of April 1985

[SEAL]

*Attest:*

DONALD J. QUIGG

*Attesting Officer* *Acting Commissioner of Patents and Trademarks*